US006971528B2

(12) United States Patent
Chen

(10) Patent No.: US 6,971,528 B2
(45) Date of Patent: Dec. 6, 2005

(54) CONNECTING STRUCTURE FOR SECTIONAL RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 133 days.

(21) Appl. No.: 10/663,501

(22) Filed: Sep. 15, 2003

(65) Prior Publication Data

US 2005/0056604 A1 Mar. 17, 2005

(51) Int. Cl.[7] ..... A47B 43/00; A47F 5/14
(52) U.S. Cl. ..... 211/182; 211/187; 211/207
(58) Field of Search ..... 211/182, 192, 189, 211/187, 186, 190, 183, 175, 207, 107, 103, 211/181.1; 248/243, 220.1, 250, 220.21, 248/220.22, 235; 108/147.17, 106, 107, 147.11, 108/147.12, 147.13, 147.14, 147.15, 147.16

(56) References Cited

U.S. PATENT DOCUMENTS 4,750,626 A * 6/1988 Nicely ..... 211/187
6,044,988 A * 4/2000 Yang ..... 211/187
6,253,933 B1 * 7/2001 Yang ..... 211/187
6,273,281 B1 * 8/2001 Berglund ..... 211/187
6,364,138 B1 * 4/2002 Chen ..... 211/187
6,726,040 B1 * 4/2004 Chen ..... 211/187

* cited by examiner

*Primary Examiner*—Jennifer E. Novosad
(74) *Attorney, Agent, or Firm*—W. Wayne Liauh

(57) ABSTRACT

A connecting structure for sectional rack includes a plurality of vertical posts, horizontal shelves, and connecting members. Each of the vertical posts is provided with at least one row of engaging holes, with which upper and lower hooks at an end of each connecting member are engaged. A pad is attached to each connecting member, so that a first side of the pad fitly bears against the vertical post. A second side of the pad opposite to the first side is a downward and outward inclined surface. Each of the horizontal shelves has an outer cover provided at each corner thereof for putting on the connecting member, so that an internal inclined surface of the outer cover pushes the inclined surface of the pad against the vertical post to enable a firm connection of the shelf, the connecting member, and the vertical post to one another.

7 Claims, 9 Drawing Sheets

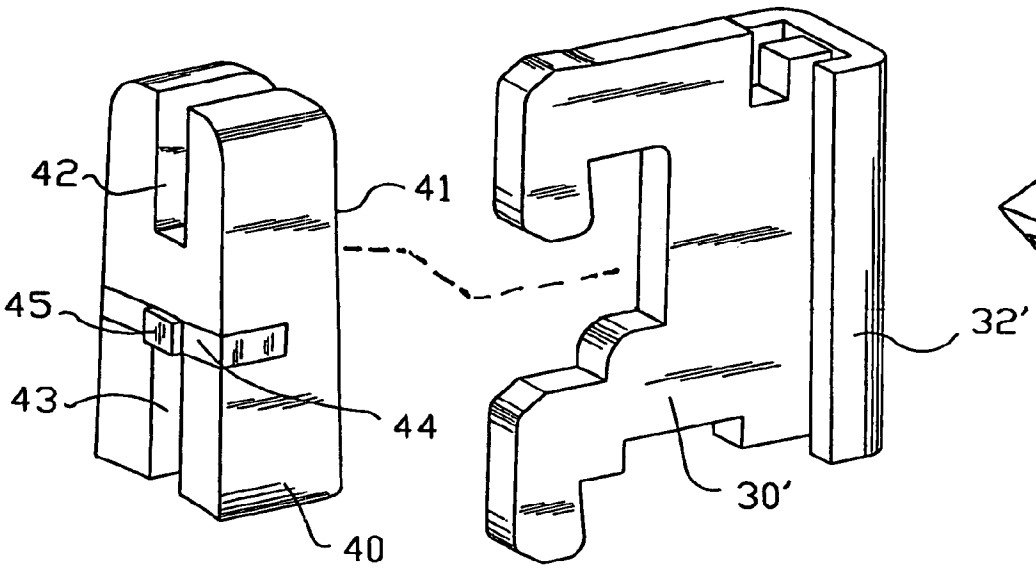
FIG.8 (AMENDED)

CONNECTING STRUCTURE FOR SECTIONAL RACK

FIELD OF THE INVENTION

The present invention relates to a connecting structure for sectional rack, and more particularly to a connecting structure that enables a sectional rack to be assembled without using any tool and to use vertical posts of different cross sections and therefore largely reduces restrictions in assembling the sectional rack.

BACKGROUND OF THE INVENTION

A sectional rack has the advantages of easy to assemble and disassemble, easy to transport, and easy to store, and therefore has been widely used at home, in offices, and in many open-shelf shops.

The sectional racks developed in early stage were assembled using screws, so that a number of shelves are supported on erected vertical posts and horizontal frames for use. Since tools are required to assemble and disassemble the above-structured sectional racks, it is inconvenient for consumers to use them. There are also developed sectional racks that can be assembled without using any tool. One of the conventional sectional racks is referred to as the bamboo-type sectional rack. U.S. Pat. Nos. 5,676,263; 5,303,645; 5,174,676; 4,991,725; 4,799,818; 4,595,107 4,546,887; and 4,763,799 all disclose such bamboo-type sectional racks.

The bamboo-type sectional rack includes vertical posts having a plurality of vertically spaced annular grooves provided thereon, externally tapered connecting members adapted to engage with the annular grooves on the vertical posts, and shelves having internally tapered short sleeves provided at four corners for tightly mounting around the externally tapered connecting members. The bamboo-type sectional rack has the following two problems in use:

1. The short sleeves of the shelf must be mounted around the connecting members from a top of the vertical posts to increase the difficulty in assembling the sectional rack. When it is desired to replace one or more of the shelves, or to change the shelves to different heights on the vertical posts, all other shelves above the shelves to be replaced or changed must be removed from the vertical posts before the target shelves can be replaced or changed. And, it is doubtlessly very inconvenient for users to do so.
2. When it is desired to have the shelves mounted at two opposite sides of one vertical post, it is impossible for two laterally adjacent shelves to locate at the same height on the vertical post, making the fully assembled sectional rack looked strange and ugly.

It is therefore tried by the inventor to develop a connecting structure for sectional rack to overcome the problems existed in the conventional bamboo-type sectional rack, so that shelves for the sectional rack may be connected to vertical posts having different cross sections, and any two laterally adjacent shelves may be located at the same height on the vertical post as desired.

SUMMARY OF THE INVENTION

A primary object of the present invention is to provide a connecting structure for sectional rack. The connecting structure includes a plurality of vertical posts, horizontal shelves, and connecting members. Each of the vertical posts is provided with at least one row of engaging holes, with which upper and lower hooks at an end of each connecting member are engaged. A pad is attached to each connecting member, so that a first side of the pad fitly bears against the vertical post. A second side of the pad opposite to the first side is a downward and outward inclined surface. Each of the horizontal shelves has an outer cover provided at each corner thereof for putting on the connecting member, so that an internal inclined surface of the outer cover is in contact with and pushes the inclined surface of the pad against the vertical post to enable a firm connection of the shelf, the connecting member, and the vertical post to one another.

In the present invention, the outer cover has an internal structure adapted to tightly clamp the pad and accordingly the connecting member, so that the outer cover, the pad, and the connecting member tightly bear against one another.

In the present invention, the pad is horizontally movable on the connecting member within a small range to enable easy engagement of the connecting member with the engaging holes on the vertical post, and push of the pad against the vertical post by the outer cover.

In the present invention, the horizontal shelves may be connected to two opposite sides of the vertical posts at the same height.

In the present invention, the vertical post is not limited to any specific cross section, but may be a round, a square, a triangular, or an oblong pipe, or a pipe having any other suitable cross section.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 8 is a perspective view of a connecting member included in a connecting structure for sectional rack according to a second embodiment of the present invention;

DETAILED DESCRIPTION OF THE PREFERRED EMBODIMENTS

Figure 1:
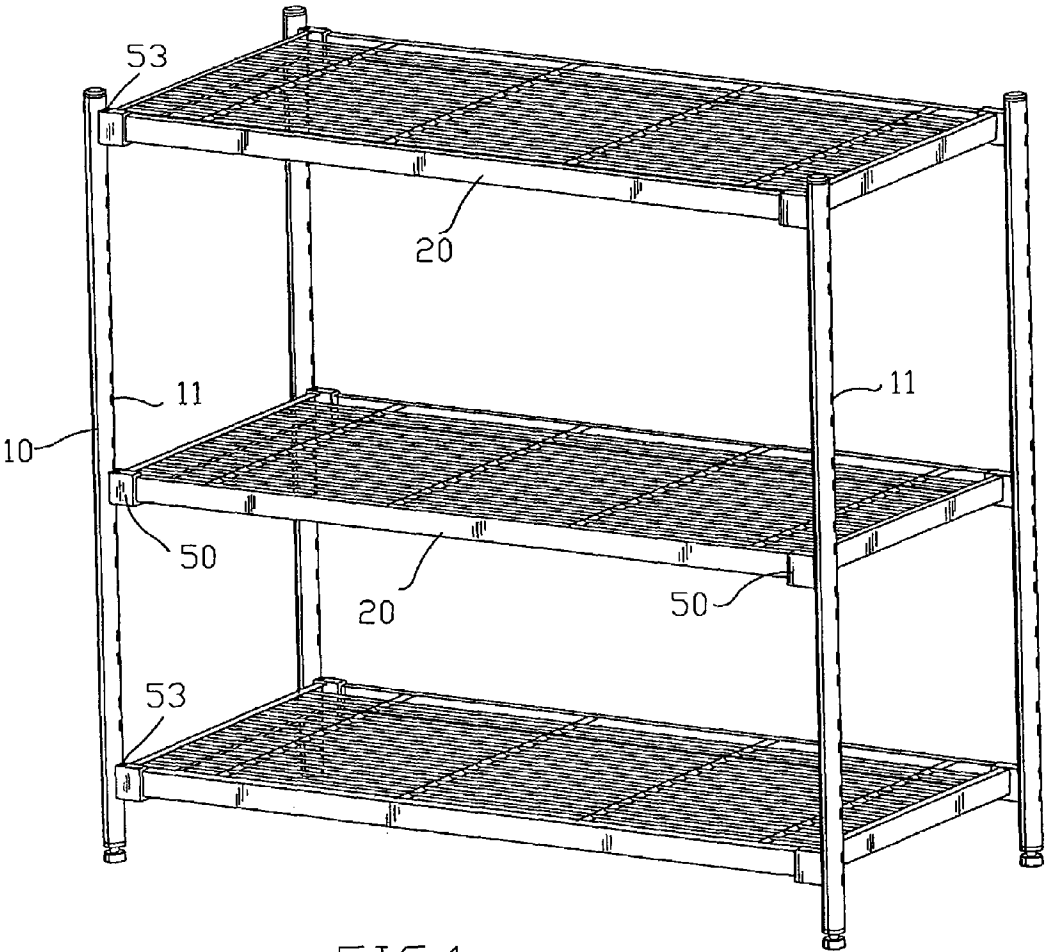
FIG. 1 is an assembled perspective view of a sectional rack using the connecting structure of the present invention.
Figure 2:
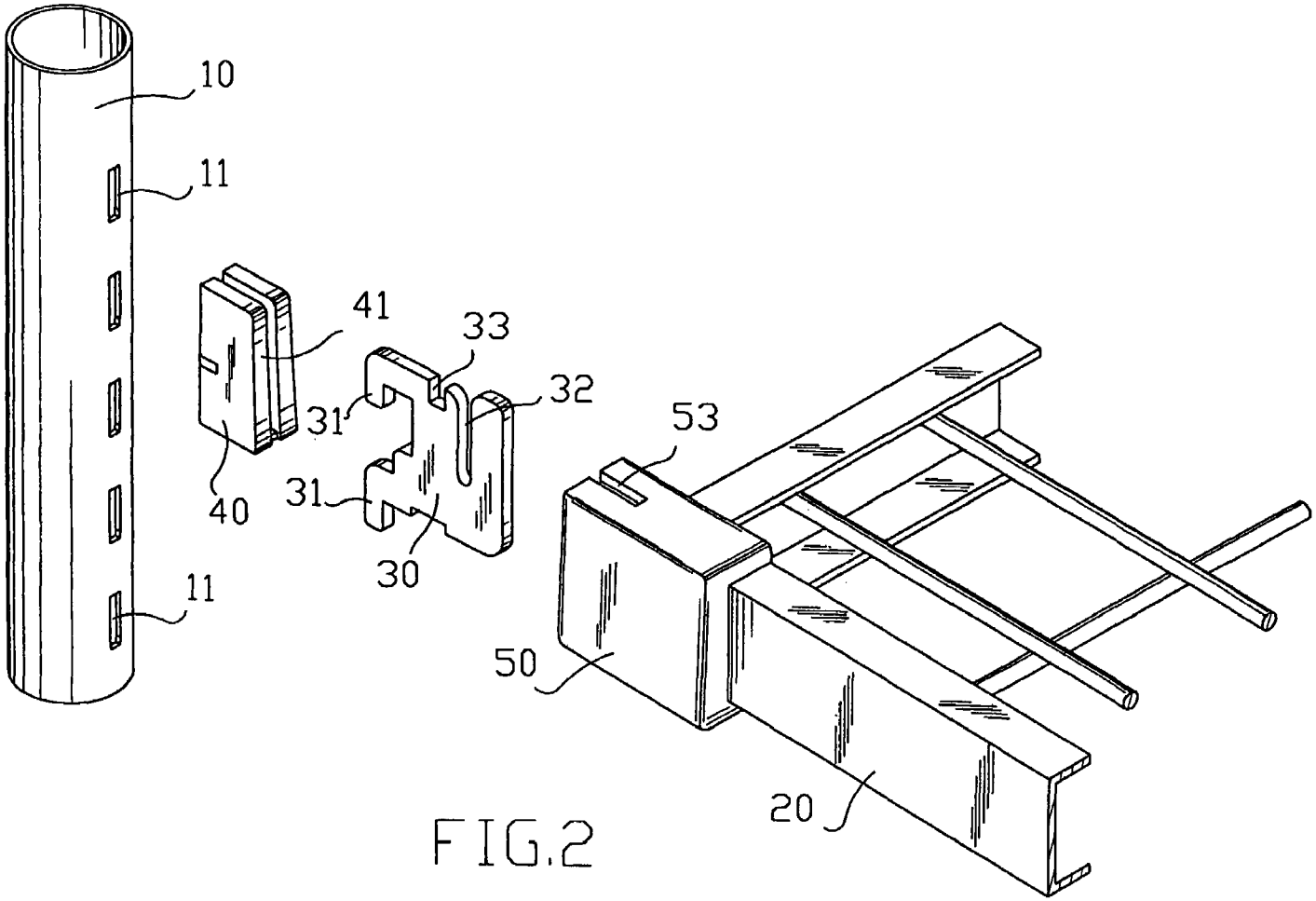
FIG. 2 is a fragmentary exploded perspective view of the connecting structure for sectional rack according to a first embodiment of the present invention.
Figure 3:
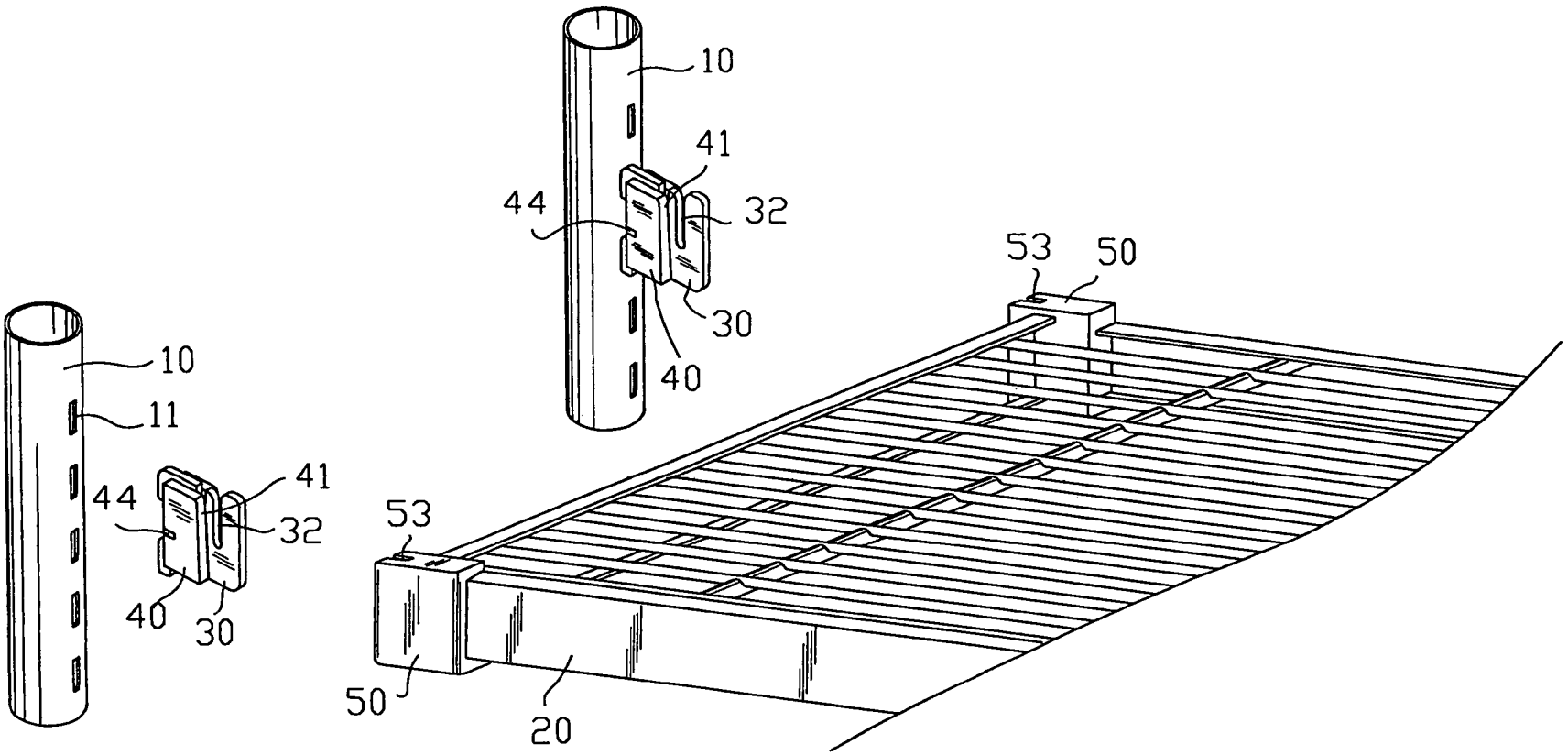
FIG. 3 is a partially assembled perspective view of the connecting structure for sectional rack according to the first embodiment of the present invention.
Figure 5:
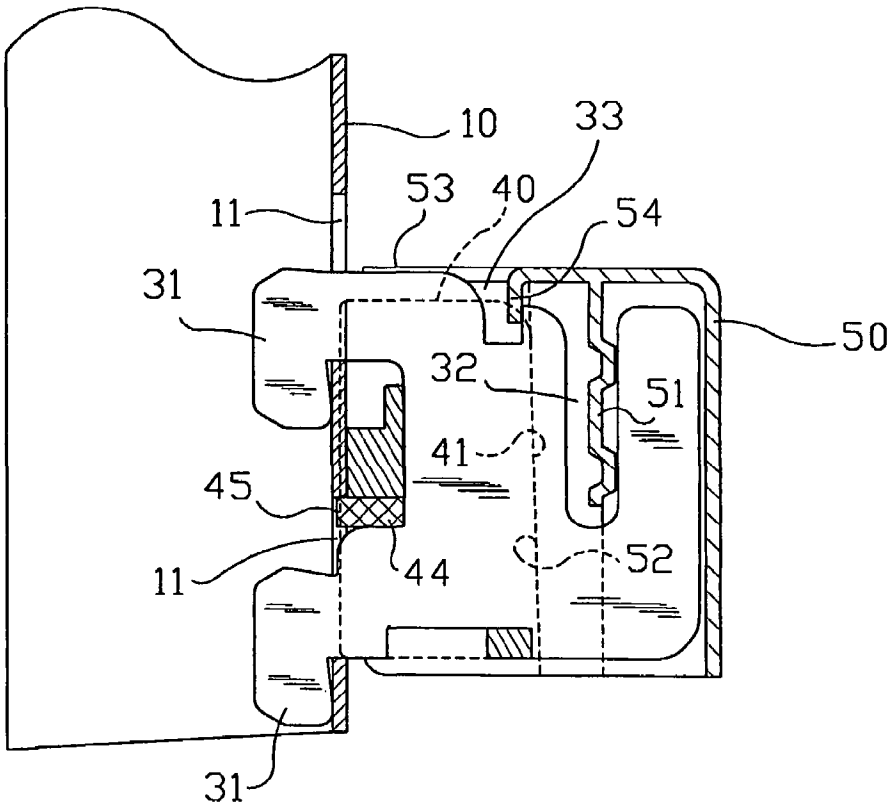
FIG. 5 is an assembled sectioned side view of the connecting structure for sectional rack according to the first embodiment of the present invention.
Figure 4:
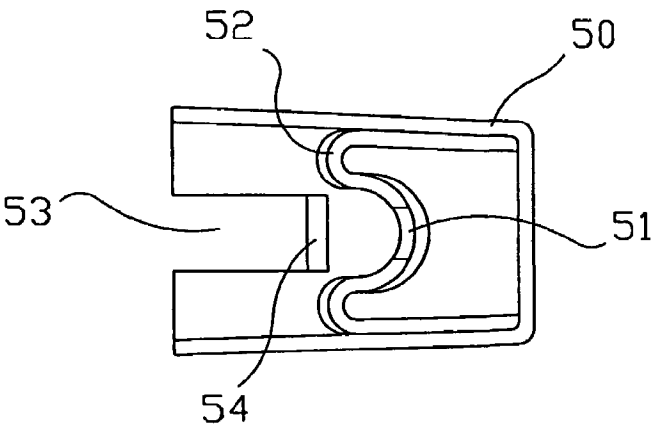
FIG. 4 is a bottom view of an outer cover included in the first embodiment of the connecting structure of the present invention.
Figure 6:
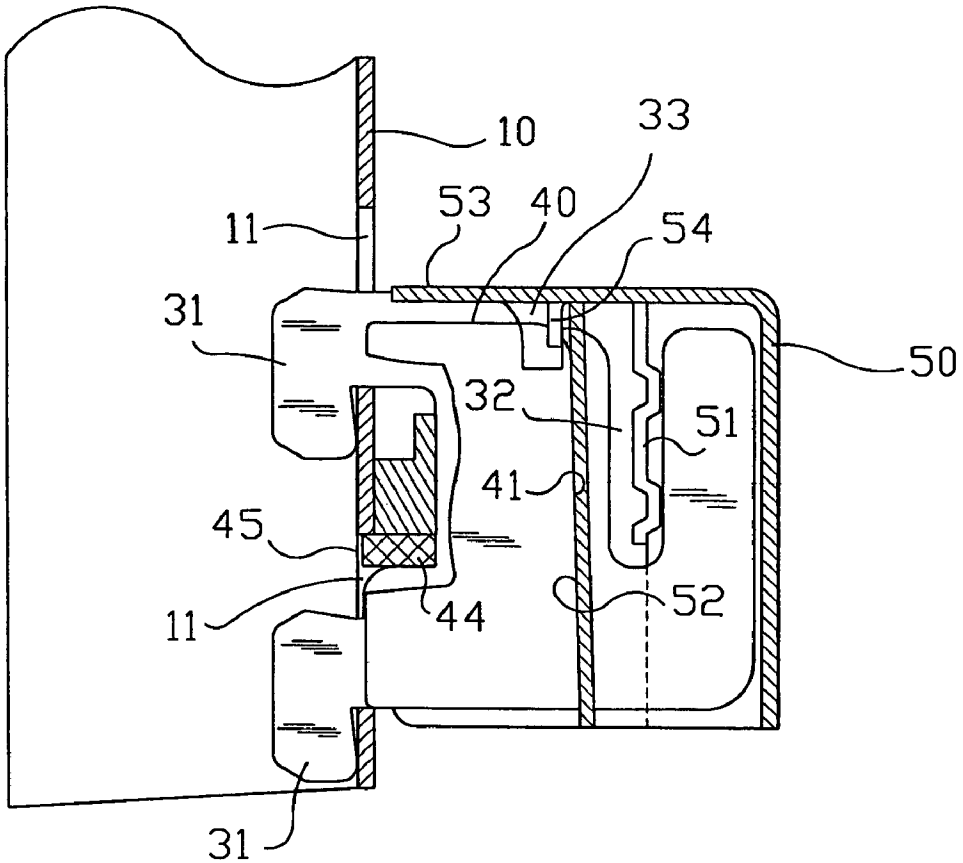
FIG. 6 is another assembled sectioned side view of the connecting structure for sectional rack according to the first embodiment of the present invention.

Please refer to FIGS. 1, 2, and 3. A connecting structure for sectional rack according to a first embodiment of the present invention mainly includes a plurality of vertical posts 10, a plurality of horizontal shelves 20, a plurality of connecting members 30, a plurality of pads 40 adapted to attach to the connecting members 30, and a plurality of outer covers 50 separately provided at four corners of the horizontal shelves 20 for engaging with the connecting members 30 and the pads 40.

Each of the vertical posts 10 is provided with one or more rows of engaging holes 11, with which the connecting members 30 are engaged to attach to the vertical post 10.

Each of the connecting members 30 is a flat member provided at a first end with upper and lower hooks 31 adapted to extend into two vertically adjacent engaging holes 11 on the vertical post 10 and thereby hold the connecting member 30 to the vertical post 10. A second end of the connecting member 30 opposite to the first end is a hooking section projected from the vertical post 10 for engaging with the outer cover 50 provided at the corner of the horizontal shelf 20. The hooking section of the connecting member 30 may include, for example, a retaining slot 32 being formed near the second end of the connecting member 30 to extend downward from a top of the connecting member 30. And, a notch 33 is provided on the top of the connecting member 30 at a predetermined point between the first and the second end.

Please refer to FIGS. 2 and 8 at the same time. Each of the pads 40 has a first side adapted to fitly bear against an outer surface of the vertical post 10. A second side of the pad 40 opposite to the first side is a downward and outward inclined surface 41. The pad 40 is provided at predetermined positions with upper and lower openings 42, 43, through which the upper and lower hooks 31 of the connecting member 30 may be passed to extend into the engaging holes 11 on the vertical post 10. The openings 42, 43 also allow the pad 40 to attach to the connecting member 30.

Please refer to FIGS. 2 to 6 at the same time. Each of the outer covers 50 has an open outer side facing toward the vertical post 10 and an open bottom. The outer cover 50 is internally provided at a top with a vertically downward extended insertion plate 51 adapted to extend into and engage with the retaining slot 32 of the connecting member 30. As can be best seen from FIGS. 4 and 6, the outer cover 50 is also provided at two lateral sides of the insertion plate 51 with two internal walls, which are downward and inward inclined surfaces 52 adapted to fitly bear against the inclined surface 41 of the pad 40 when the latter is associated with the connecting member 30 and positioned in the outer cover 50. When the outer covers 50 provided at four (or three) corners of the shelf 20 are assembled to corresponding connecting members 30 and pads 40 that have been connected to the vertical posts 10, the horizontal shelf 20 is firmly connected to vertical posts 10 to form an assembled sectional rack, as shown in FIG. 1.

When the outer cover 50 is engaged from the open bottom thereof with a top of the associated connecting member 30 and pad 40 already connected to the engaging holes 11 on the vertical post 10 and gradually moved downward, the internal inclined surfaces 52 together apply a gradually increased pushing force against the inclined surface 41 of the pad 40 and thereby firmly push the first side of the pad 40 against the outer surface of the vertical post 10. Meanwhile, the outer cover 50 is gradually pushed by the inclined surface 41 of the pad 40 away from the vertical post 10, and the insertion plate 51 engaged with the retaining slot 32 of the connecting member 30 pulls the connecting member 30 outward relative to the vertical post 10 to tightly press the upper and lower hooks 31 against inner sides of the engaging holes 11. Therefore, the outer cover 50, the connecting member 30, the pad 40, and the vertical post 10 are tightly connected to one another.

The outer cover 50 is provided at the top with a long cut 53, an inner end of which has a downward extended lug 54. When the outer cover 50 is engaged with the connecting member 30, the lug 54 is extended into the notch 33 on the top of the connecting member 30 while the top of the connecting member 30 is extended into the long cut 53. The engaged lug 54 and notch 33 provides the outer cover 50 and the connecting member 30 with an additional contact point to share loads on the connecting member 30, and the engagement of the long cut 53 with the top of the connecting member 30 prevents the outer cover 50 from moving relative to the connecting member 30.

Figure 7:
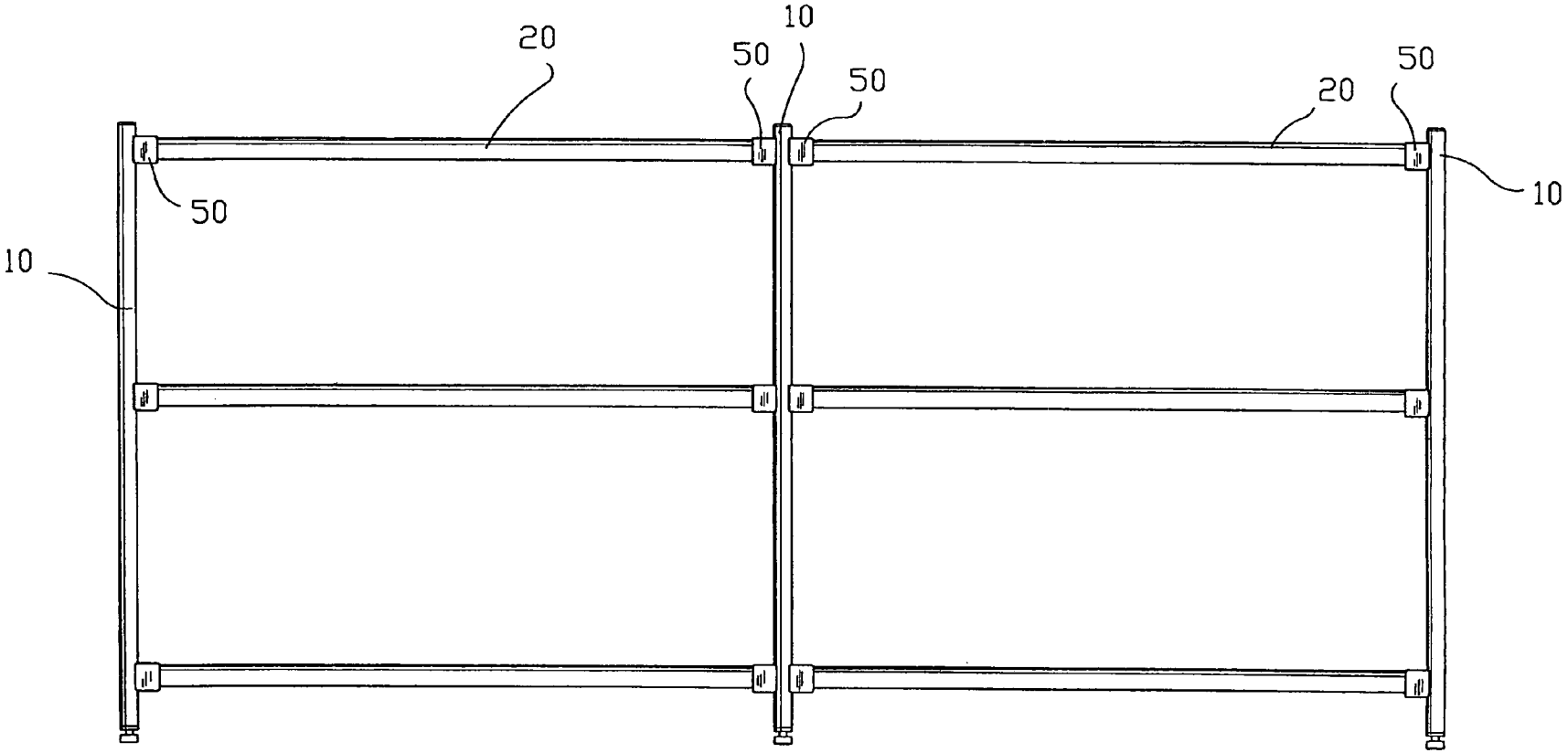
FIG. 7 is a front elevation of a sectional rack using the connecting structure of the present invention to enable two laterally adjacent shelves to locate at the same height.
Figure 9:
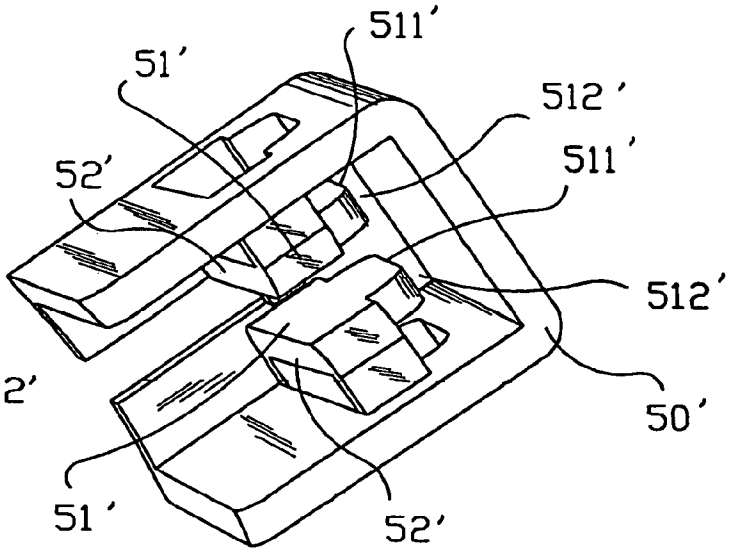
FIG. 9 is a bottom perspective view of an outer cover included in a connecting structure for sectional rack according to a second embodiment of the present invention.

The horizontal shelf 20 is fixedly connected to the vertical posts 10 via the engagement of the outer covers 50 with the connecting members 30 and the pads 40. Since the associated connecting member 30 and pad 40 are located at only one side of the vertical post 10, the vertical post 10 may be symmetrically provided at an opposite side with another row of engaging holes 41 for two shelves 20 to connect to two opposite sides of the vertical post 10 at the same height, as shown in FIG. 7, giving the assembled sectional rack a harmonious and esthetic appearance that is more easily accepted by consumers.

The pad 40 is made of a plastic material to possess a certain degree of compressibility, which allows the pad 40 to slightly deform under compression and thereby create a pushing and locating effect. The first side of the pad 40 has a configuration mating with the outer surface of the vertical post 10, allowing the pad 40 to closely bear against the vertical post 10 when the pad 40 is subject to a compressive force. A metal piece 44 is embedded in the pad 40 at a predetermined position with a nose 45 forward projected from the first side of the pad 40, as shown in FIG. 8. When the pad 40 is pushed toward the outer surface of the vertical post 10 by the outer cover 50, the nose 45 is extended into a lower one of the two engaging holes 11 engaged with the upper and lower hooks 31 and is located near an upper end of the lower engaging hole 11. With these arrangements, lifting of the outer covers 50 to remove the horizontal shelf 20 from the sectional rack would not bring the pads 40 to move upward along with the outer covers 50, permitting the connecting members 30 and the pads 40 to stay at the vertical posts 10. Moreover, the pad 40 has two downward and outward inclined lateral sides between the first and the second side to define a downward increasing width between the two lateral sides. The downward increasing width of the pad 40 facilitates easy alignment of the outer cover 50 with the pad 40.

A lower end of the engaging hole 11 on the vertical post 10 has a width slightly smaller than a thickness of the hooks 31. When the connecting member 30 is subjected to a downward force, the hooks 31 are more tightly engaged with the engaging holes 11 to give the assembled sectional rack increased structural strength and stability.

FIGS. 8 to 12 illustrates a second embodiment of the present invention having a square-sectioned vertical post 10', a connecting member 30', and an outer cover 50' different from the vertical post 10, the connecting member 30, and the outer cover 50 in the first embodiment. The connecting member 30' is provided at an end facing away from the vertical post 10' with a vertically extended guide rail 32' to replace the retaining slot 32 on the connecting member 30. The outer cover 50' has two lateral sides that are inward stamped to form two projections 51'. A front side 52' of each projection 51' facing toward the pad 40 is a downward and inward inclined surface adapted to fitly bear against the inclined surface 41 of the pad 40 and therefore apply a compressive force on the pad 40. A rear side 511' of the projection 51' opposite to the front side 52' and an inner wall surface of the outer cover 50' together define a guide space 512' between them to engage with the guide rail 32' of the connecting member 30'. When the outer cover 50' is put over the associated pad 40 and connecting member 30', the inclined front sides 52' of the two inward projections 51' together push the pad 40 toward the vertical post 10'. When the outer cover 50' moves downward and is pushed away from the vertical post 10' by the inclined surface 41 of the pad 40, the guide rail 32' of the connecting member 30' in the guide space 512' is pulled in a direction opposite to the vertical post 10', making another end of the connecting member 30' opposite to the guide rail 32' to firmly press against an inner side of the engaging holes on the vertical post 10'.

Figure 11:
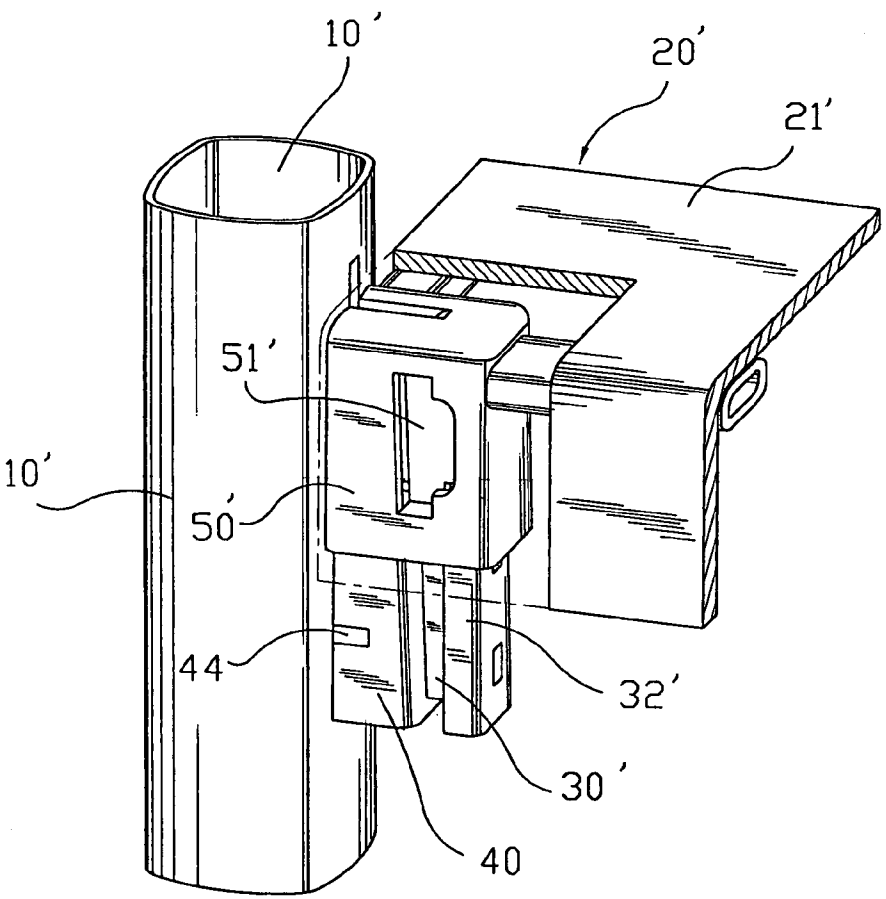
FIG. 11 is a fully assembled perspective view of the connecting structure for sectional rack according to the second embodiment of the present invention, wherein a part of a shelf of the sectional rack is cut away to better show the assembled connecting structure.
Figure 10:
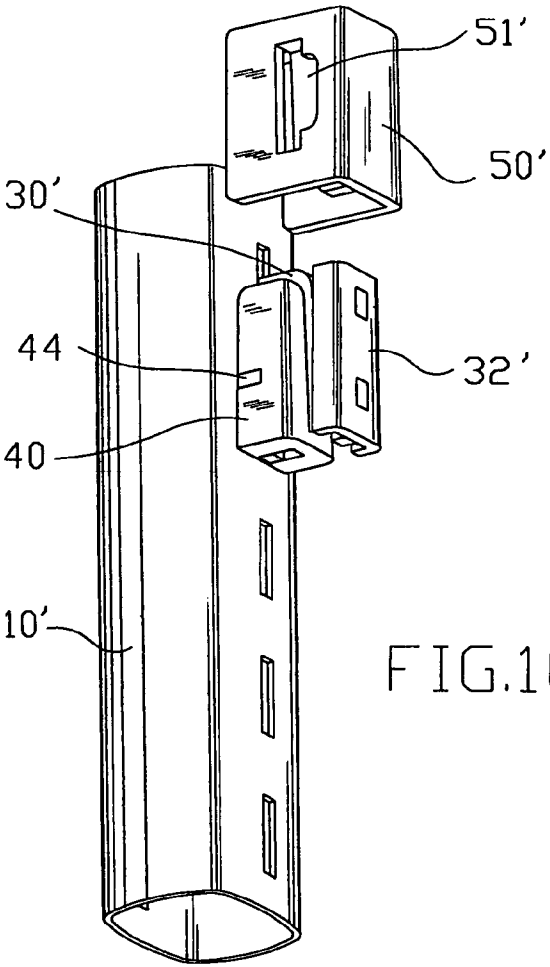
FIG. 10 is a partially assembled perspective view of the connecting structure for sectional rack according to the second embodiment of the present invention.
Figure 12:
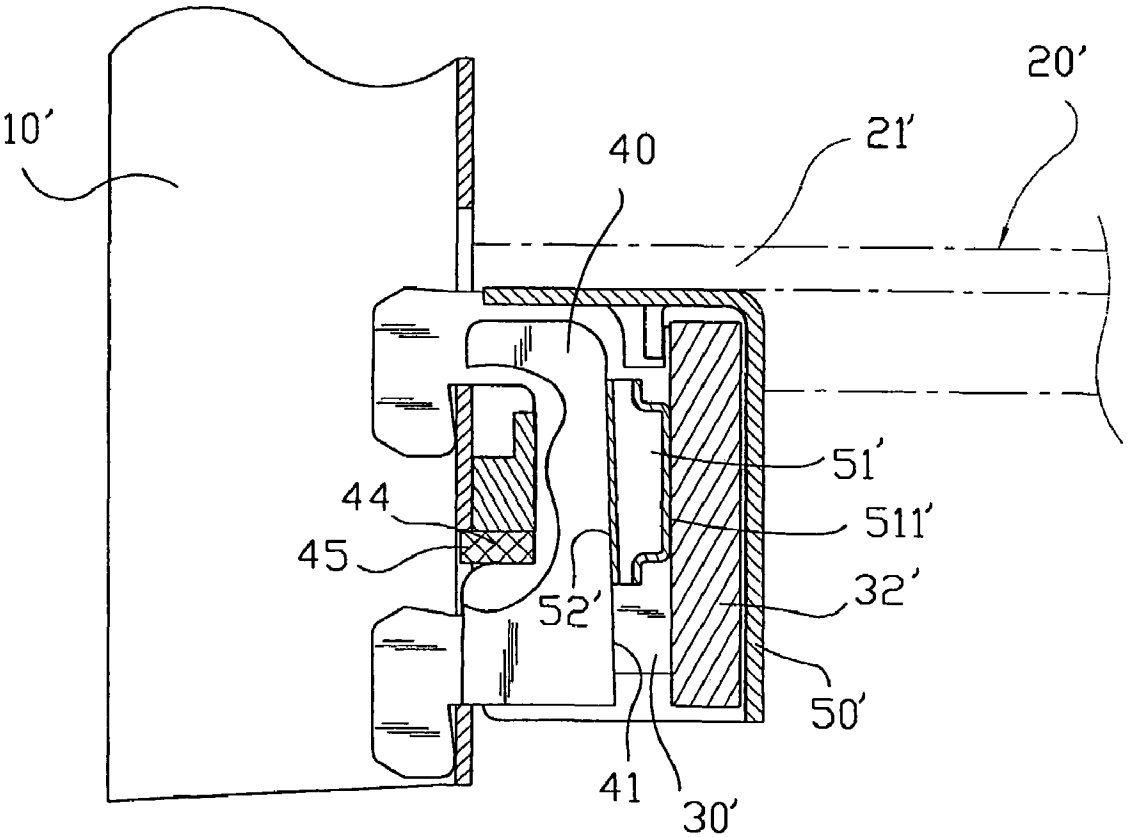
FIG. 12 is a sectioned side view of FIG. 11.

The vertical post may be a round-sectioned pipe 10 as shown in the first embodiment of the present invention, a square-sectioned pipe 10' as shown in the second embodiment of the present invention, a triangle-sectioned pipe (not shown), an oblong-sectioned pipe (not shown), or any other differently sectioned pipe suitable for using as vertical posts of a sectional rack. The horizontal shelf 20 in the first embodiment of the present invention includes a net. However, a shelf 20' including a wooden plate 21' as shown in FIG. 11 is also acceptable.

In brief, the present invention has the following advantages and can therefore have widened applications:

1. The vertical posts may be of differently sectioned pipes without being limited to any specific shape.
2. The horizontal shelves may be freely assembled to and disassembled from the vertical posts, allowing consumers to assemble the sectional rack according to personal preference.

What is claimed is:

1. A connecting structure for sectional rack, comprising:

a plurality of vertical posts, a plurality of horizontal shelves, a plurality of connecting members, a plurality of pads adapted to attach to said connecting members, and a plurality of outer covers separately provided at each corner of said horizontal shelves for engaging with said connecting members and said pads;

each of said vertical posts being provided with at least one row of engaging holes, with which said connecting members are engaged to attach to said vertical post;

each of said connecting members being provided at a first end with upper and lower hooks adapted to extend into two vertically adjacent engaging holes on said vertical post and thereby holding said connecting member to said vertical post; a second end of said connecting member opposite to said first end being located outside said vertical post and formed into a hooking section for engaging with said outer cover provided at each corner of said horizontal shelf;

each of said pads having a first side adapted to fitly bear against an outer surface of said vertical post, and a second side of said pad opposite to said first side being a downward and outward inclined surface; said pad being provided at predetermined positions with upper and lower openings, through which said upper and lower hooks of said connecting member are adapted to be passed to engage with said pad and extend into said engaging holes on said vertical post; and each of said outer covers having an open outer side facing toward said vertical post and an open bottom, and being provided with two internal walls, which are downward and inward inclined surfaces adapted to fitly bear against said inclined surface at the second side of said pad when said pad is associated with said connecting member and covered by said outer cover;

whereby when said outer cover is fully engaged with said connecting member and said pad that have already been connected to said engaging holes on said vertical post, said inward inclined surfaces of said outer cover apply a pushing force against said inclined surface of said pad to firmly push said pad against the outer surface of said vertical post, while said outer cover pulls said connecting member outward via said hooking section to tightly press said upper and lower hooks of said connecting member against inner sides of said engaging holes, causing said outer cover, said connecting member, said pad, and said vertical post to tightly connect to one another for said horizontal shelf to be stably supported on said vertical posts.

2. The connecting structure for sectional rack as claimed in claim 1, wherein said hooking section of said connecting member includes a retaining slot vertically downward extended from a top of said connecting member, and said outer cover is internally provided at a top with a vertically downward extended insertion plate adapted to extend into and engage with said retaining slot of said connecting member.

3. The connecting structure for sectional rack as claimed in claim 1, wherein said hooking section of said connecting member includes a vertically extended guide rail, and said outer cover is internally provided with a guide space adapted to engage with said guide rail of said connecting member.

4. The connecting structure for sectional rack as claimed in claim 3, wherein said outer cover has two lateral sides that are stamped to form two projections, a first side of each said projection facing toward said pad being a downward and inward inclined surface adapted to fitly bear against said inclined surface of said pad, and a space between a second side of each said projection opposite to said front side and an inner wall surface of said outer cover forming said guide space.

5. The connecting structure for sectional rack as claimed in claim 1, wherein said outer cover is provided at a top with a cut, an inner end of which has a downward extended lug, and said connecting member is correspondingly provided at a top with a notch, whereby when said outer cover is put on said connecting member, said lug is extended into said notch on the top of said connecting member while the top of said connecting member is extended into said cut of said outer cover.

6. The connecting structure for sectional rack as claimed in claim 1, wherein said pad has an embedded metal piece, a portion of which is forward projected from the first side of said pad to form a nose, said nose being adapted to extend into a lower one of said two engaging holes on said vertical post engaged with said upper and lower hooks of said connecting member when said pad is firmly pushed against said vertical post by said outer cover.

7. The connecting structure for sectional rack as claimed in claim 1, wherein said pad has two downward and outward inclined lateral sides between said first and said second side to define a downward increasing width between said two lateral sides.

* * * * *